US007466953B2

(12) United States Patent
Matsumoto

(10) Patent No.: US 7,466,953 B2
(45) Date of Patent: Dec. 16, 2008

(54) FIXING DEVICE AND IMAGE FORMING APPARATUS

(75) Inventor: Hiroshi Matsumoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 95 days.

(21) Appl. No.: 11/724,302

(22) Filed: Mar. 15, 2007

(65) Prior Publication Data

US 2007/0280756 A1 Dec. 6, 2007

(30) Foreign Application Priority Data

Jun. 1, 2006 (JP) ..... 2006-153229

(51) Int. Cl.
*G03G 15/20* (2006.01)

(52) U.S. Cl. ..... 399/329

(58) Field of Classification Search ..... 399/320, 399/329, 328

See application file for complete search history.

(56) References Cited

U.S. PATENT DOCUMENTS 6,928,257 B2 * 8/2005 Ogiso et al. ..... 399/329
7,027,763 B2 * 4/2006 Kato et al. ..... 399/329
7,308,219 B2 * 12/2007 Shishido ..... 399/329 X
7,383,012 B2 * 6/2008 Sata ..... 399/329

FOREIGN PATENT DOCUMENTS

JP 2004-109878 4/2004

* cited by examiner

*Primary Examiner*—Sandra L Brase
(74) *Attorney, Agent, or Firm*—Finnegan, Henderson, Farabow, Garrett & Dunner, L.L.P.

(57) ABSTRACT

In a fixing device which fixes toner image on a recording material while using a nipping section which is formed between a fixing roller heated by a heating section and a fixing belt which is formed to be endless and rotated by the fixing roller, wherein the fixing device includes a pressing section which presses the fixing belt from an inner surface of the fixing belt against the fixing roller, a sliding member which is mounted between the fixing belt and the pressing section via a lubricant, and a supporting member which supports the inner peripheral surface of an end section of the fixing belt with respect to an axial direction of the fixing belt, wherein a predetermined clearance is provided between the sliding member and the supporting member with respect to the axial direction of the fixing belt.

6 Claims, 3 Drawing Sheets

FIXING DEVICE AND IMAGE FORMING APPARATUS

This application is based on Japanese Patent Application No. JP2006-153229 filed on Jun. 1, 2006, with the Japanese Patent Office, the entire content of which is hereby incorporated by reference.

TECHNICAL FIELD

The present invention relates to a fixing device which is used for an electro-photographic image forming apparatus, such as an image copier, a printer, a facsimile and a compound apparatus having functions of the above apparatus, and in particular, to a fixing device in which heat and pressure are used to fix toner images on a recording material by a nip section which is formed between a fixing roller and an endless fixing belt, and an image forming apparatus which employs the same fixing device.

BACKGROUND OF THE INVENTION

In an electro-photographic image forming apparatus, such as an image copier, printer, facsimile and a compound apparatus having the functions of the above apparatus, firstly, latent images of a document are formed on a photosensitive drum, after toner is applied to the latent images to become actual, next the actual toner images are transferred onto a recording material, after which the toner images on the recording material are fixed, whereupon the recording material carrying the fixed images is ejected from the electro-photographic image forming apparatus.

Further, in the case of color image formation, latent images of Y (yellow), M (magenta), C (cyan) and K (black), which correspond to colors of the document, are formed on four separate photosensitive drums, the actual four color toner images are firstly transferred onto an intermediate transfer belt, and which are secondarily transferred onto the recording material, then the toner images are fixed to be ejected from the color image forming apparatus.

Such fixing device to fix the toner images on the recording material, incorporates a fixing roller which houses a halogen lamp as a heating means, and a pressure applying roller to press against the fixing roller, whereby a nipping section, which is structured of the fixing roller and the pressure applying roller, nips the recording material to be conveyed, and also heats it to fix the image, which is a fixing device as a heat roller fixing method. The structure of this type of fixing device is very simple, which is commonly used in various image forming apparatuses.

In this fixing device, in order to speed up the fixing operation, a large amount of heat energy is required for the toner and the recording material, therefore, the nipping width is required to be increased. For this purpose, it is also conceivable to increase the force, with which the pressure applying roller presses against the fixing roller, the thickness of the elastic layer of the pressure applying roller, which is formed of silicon rubber, and the diameter of each of the above two rollers.

However, if the force of the pressure applying roller and the thickness of the elastic member are increased, the nipping width can become uneven with respect to the axis of the roller, which results in uneven fixing and generation of creases of the recording material. Further, if the diameter of the rollers is increased, the overall size of the fixing device becomes larger, as well requiring a longer warm-up time.

In order to overcome these problems, a fixing device is disclosed in Unexamined Japanese Patent Application Publication No. 2004-109,878, which incorporates a rotating fixing roller which has an elastic layer formed of silicon rubber and houses a halogen lamp as a heating means, an endless fixing belt which is driven by the fixing roller, and a compressible pad which is mounted against the inner peripheral surface of the fixing belt, so that the compressible pad presses the fixing belt against the fixing roller.

According to this fixing device, since the fixing belt is pressed against the fixing roller by a compressible pad, the fixing belt deforms elastically whereby a wide nipping section is generated between the fixing roller and the fixing belt. Accordingly, acceleration of fixing is realized without any size increase of the fixing device. Further, the heat capacity of the fixing belt is so small that the warm-up time is reduced, as well as energy saving is performed.

In the fixing device of Unexamined Japanese Patent Application Publication No. 2004-109,878, since the inner peripheral surface of the looped and rotating fixing belt comes into contact with the compressible pad which does not rotate, the sliding(rubbing) resistance between them is quite large, which results in various problems. That is, poor quality of fixed images due to slippage of the fixing belt, power consumption of a motor which drives the fixing belt increases due to increased driving torque of the fixing belt, reduction gears are stressed and may be damaged, and the inner peripheral surface of the fixing belt is abraded away. To reduce the sliding resistance between the inner peripheral surface of the fixing belt and the compressible pad, a special lubricant applying member is mounted to be pressed against the inner peripheral surface of the fixing belt, and which is formed of a porous material, such as a sponge to apply silicon oil as a lubricant. Further, a low sliding sheet is mounted between the compressible pad and the fixing belt.

However, the lubricant, existing between the fixing belt and the sliding member, penetrates into the axial direction due to capillary action, and further, it turns to appear on the surface of the fixing belt, so that the fixing belt slips against the fixing roller, and eventually the lubricant attaches itself to the recording material, which result in poor image formation.

Accordingly, in Unexamined Japanese Patent Application Publication No. 2004-109,878, a countering member is mounted at both sides of the sliding member to prevent any leakage of the lubricant.

This however, increases the size of the fixing device in the axial direction of the fixing device, as well as increasing production cost.

An object of the present invention is to provide a fixing device in which the lubricant between the fixing belt and the sliding member is prevented from penetrating into the axial direction caused by capillary action and from appearing on the surface of the fixing belt, without using any specific leakage preventing member, and further to provide an image forming apparatus incorporating the same fixing device.

SUMMARY OF THE INVENTION

The above-described problem will be overcome by the structures described below.

Structure 1

A fixing device which fixes toner image on a recording material while using a nipping section which is formed between a fixing roller heated by a heating section and a fixing belt which is formed to be endless and rotated by the fixing roller, including:

a pressing section which presses the fixing belt from an inner peripheral surface of the fixing belt against the fixing roller;

a sliding member which is mounted between the fixing belt and the pressing section via a lubricant; and a supporting member which supports the inner peripheral surface of an end section of the fixing belt with respect to an axial direction of the fixing belt;

wherein a predetermined clearance is provided between the sliding member and the supporting member with respect to the axial direction of the fixing belt.

Structure 2

An image forming apparatus which includes the fixing device of structure 1.

DETAILED DESCRIPTION OF THE PREFERRED EMBODIMENT

Figure 1:
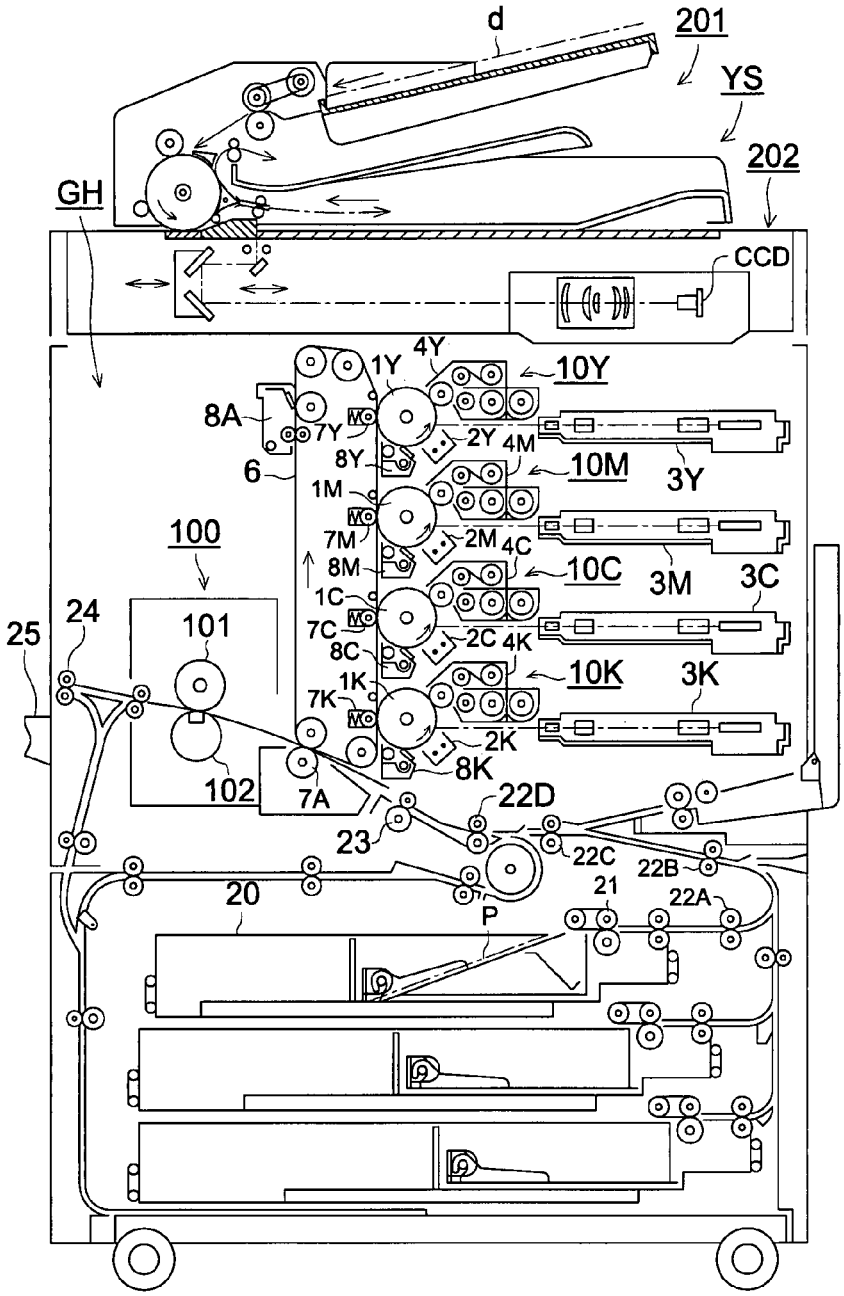
FIG. 1 is an overall structural view of the image forming apparatus.

An embodiment relating to the image forming apparatus of the present invention will now be detailed while referring to the drawings.

Firstly, an example of the image forming apparatus will be detailed while referring to the overall structural view of FIG. 1.

The present image forming apparatus is structured of image forming apparatus main body GH (hereinafter referred to as main body GH) and image reading apparatus YS.

Main body GH is a tandem type color image forming apparatus, including plural image forming sections 10Y, 10M, 10C and 10K, intermediate transfer belt 6, a sheet supply-conveyance section, and fixing device 100.

Image reading apparatus YS, including automatic document feeding section 201 and document image scanning exposure section 202 (hereinafter referred to as scanning exposure section 202), is mounted on main body GH. Document "d", which is placed on a document platen of scanning exposure section 201, is conveyed by a conveyance section to scanning exposure section 202, where the images on a single surface or on double surfaces of document d are scanned to be exposed, and the images are read by line image sensor CCD to be transformed into electrical signals, via photo-electric transformation.

After the electrical signals are processed through analog processing, A/D conversion, shading correction and image compression, the processed signals are sent to exposure sections 3Y, 3M, 3C and 3K.

Yellow image forming section 10Y, which forms the yellow (Y) portion of the full-color images, includes electro-charging section 2Y, exposure section 3Y, developing section 4Y and cleaning section 8Y, all being located around photoconductive drum 1Y.

Magenta image forming section 10M, which forms the magenta (M) portion of the full-color images, includes electro-charging section 2M, exposure section 3M, developing section 4M and cleaning section 8M, all being located around photoconductive drum 1M.

Cyan image forming section 10C, which forms the cyan (C) portion of the full-color images, includes electro-charging section 2C, exposure section 3C, developing section 4C and cleaning section 8C, all being located around photoconductive drum 1C.

Black image forming section 10K, which forms the black (K) portion of the full-color images, includes electro-charging section 2K, exposure section 3K, developing section 4K and cleaning section 8K, all being located around photoconductive drum 1K.

Further, electro-charging section 2Y and exposure section 3Y, electro-charging section 2M and exposure section 3M, electro-charging section 2C and exposure section 3C, and electro-charging section 2K and exposure section 3K, each pair respectively structures a latent image forming section.

Developing sections 4Y, 4M, 4C and 4K use dual component developers including small grain sized toner and carrier for yellow Y, magenta M, cyan C and black K, respectively.

Intermediate transfer belt 6 is entrained about several rollers.

In fixing device 100, the toner images are fixed by heat and pressure, at the nipping section, which is formed between fixing roller 101 and fixing belt 102, and nips recording sheet P (which is a recording material) carrying the toner image.

Color images formed by image forming sections 10Y, 10M, 10C and 10K are sequentially transferred onto intermediate transfer belt 6 by transfer sections 7Y, 7M, 7C and 7K, respectively (which is a first transfer operation), to become the respective single color toner images of the resultant full-color image. Numerous recording sheets P, stored in cassette 20, are supplied individually to sheet supplying section 21 and further conveyed to transfer section 7A via sheet supply rollers 22A, 22B, 22C, 22D and registration rollers 23, where color images are transferred onto recording sheet P (which is a secondary transfer operation). Recording sheet P, carrying the unfixed transferred color images, is heated and pressed by fixing device 100, that is, the color toner images are fixed onto a recording sheet P. Sheet P is then nipped by paired ejecting rollers 24 and ejected onto sheet ejection tray 25.

In addition, after the color images are transferred on recording sheet P by transfer section 7A, recording sheet P is separated from intermediate transfer section 6 and remaining toner on intermediate transfer section 6 is removed by cleaning section 8A.

Further, the above descriptions concern a full-color image forming apparatus, but structure of only a monochromatic image forming apparatus is also used, and all of the color transfer sections can be omitted.

Figure 2:
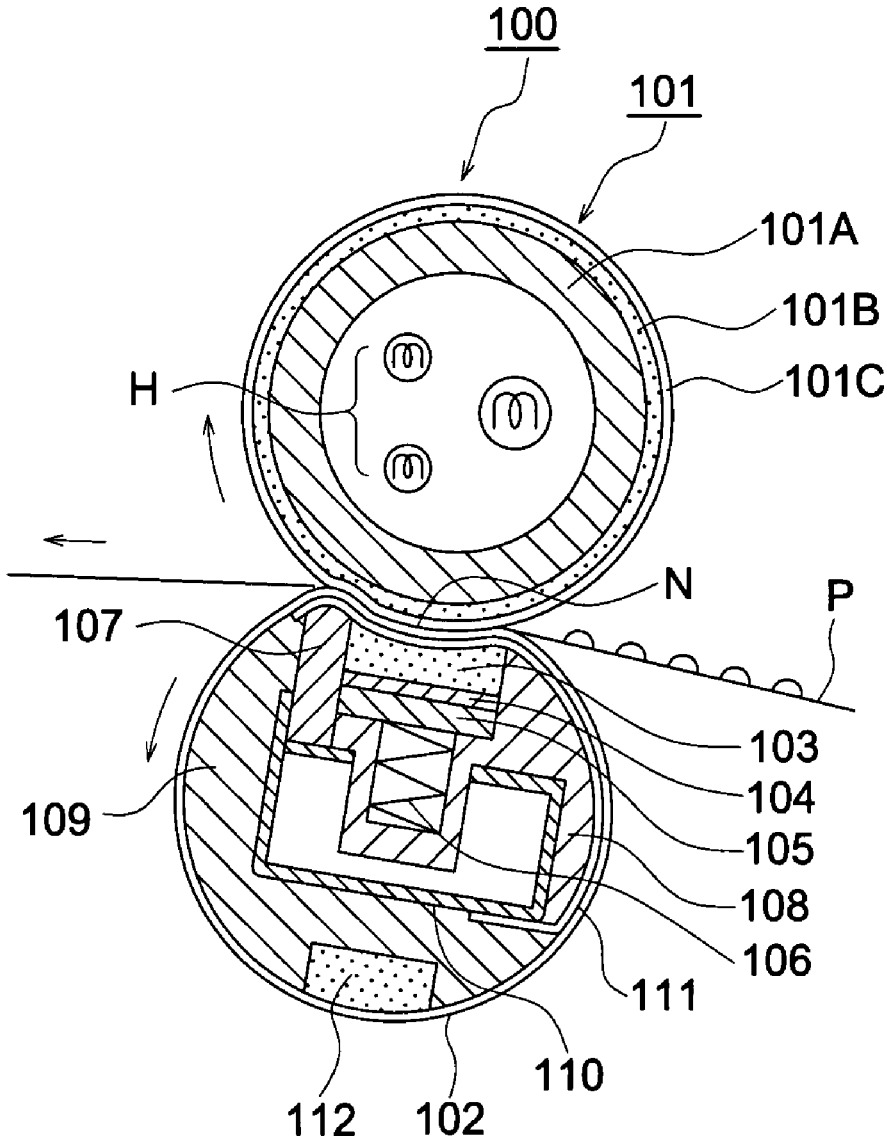
FIG. 2 is a sectional view of the fixing device, taken along by a surface perpendicular to each axis.

The main structure of fixing device 100 relating to the present invention will now be detailed while referring to FIG. 2, which shows the sectional drawing taken perpendicular to the longitudinal axis of rollers 101 and 102.

Fixing roller 101, incorporating halogen lamp H as a heating member, includes cylindrical heart metal 101A which is molded of aluminum or steel, elastic member 101B which is formed of high heat-resistant silicon rubber, which covers cylindrical heart metal 101A, and separating layer 101C which is formed of fluorocarbon resin, such as PFA (perfluoroalkoxy) and PTFE (polytetrafluoroethylene), which covers elastic layer 101B.

Fixing belt 102 is structured of a base layer which is formed of 100 μm polyimide, and a separating layer which is formed of 25 μm PFA or PTFE, and covers the base layer.

Compressible pad 103 is provided on the inner surface of fixing belt 102, and is formed of silicon rubber of hardness at 10 degrees based on JISA. Compressible pad 103, stainless steel base plate 104 and heat-resistant resin base member 105 are supported by holder 108 formed of heat-resistant resin. Further, helical compression spring 106 is provided between base member 105 and holder 108.

Hereinafter, compressible pad 103, base plate 104, base member 105 and helical compression spring 106 are collectively referred to as the pressing section.

In order to capably separate fixed recording sheet P from the nipping section, separating member 107 is formed of heat-resistant resin or aluminum, which is supported by holder 108 and holder 109, both of which are formed of heat-resistant resin.

Holders 108 and 109 are supported by metal frame 110 which is mounted in the center thereof.

Sliding member 111 is formed of a fiber-glass sheet coated with Teflon (which is a registered trademark), or a PTFE (which is polytetrafluoroethylene) sheet. Sliding member 111 is mounted between the inner surface of fixing belt 102 and compressible pad 103, and is also mounted between the inner surface of fixing belt 102 and separating member 107. The top of sliding member 111 is connected to metal frame 110.

Oil pad 112 (which is a lubricant supplying member) is formed of a sponge to include lubricant, such as silicon oil, and is supported by holder 109 and pressed against the inner surface of fixing belt 102.

When fixing belt 102 rotates, holder 108 guides fixing belt 102 through sliding member 111, while holder 109 directly touches fixing belt 102, that is, holder 109 functions as a guide member.

In a fixing device 100 structured like above, fixing roller 101 is heated by halogen lamp H, and rotates clockwise by a driving section, which is not illustrated. Further, compressible pad 103 is pressed by helical compression spring 106 through base plate 104 and base member 105, so that compressible pad 103 presses fixing belt 102 against fixing roller 101 through sliding member 111. Still further, separating member 107 presses fixing belt 102 against fixing roller 101 through sliding member 111.

Fixing roller 101 rotates clockwise, whereby fixing belt 102 rotates counterclockwise, and fixing belt 102 is elastically deformed, and thereby compresses compressible pad 103 against fixing roller 101, whereby nip section N of a relatively long curved contact is generated between fixing belt 102 and fixing roller 101. Un-fixed toner carried on recording sheet P is heated and pressed in nip section N and thereby fixed.

In addition, the inner surface of fixing belt 102 slips against slipping member 111 during rotation, but the friction coefficient of sliding member 111 is very low, that is, the sliding resistance between them is very small. Further the silicon oil serving as the lubricant is supplied from oil pad 112 onto the inner surface of fixing belt 102, whereby the sliding resistance becomes very low.

Figure 3:
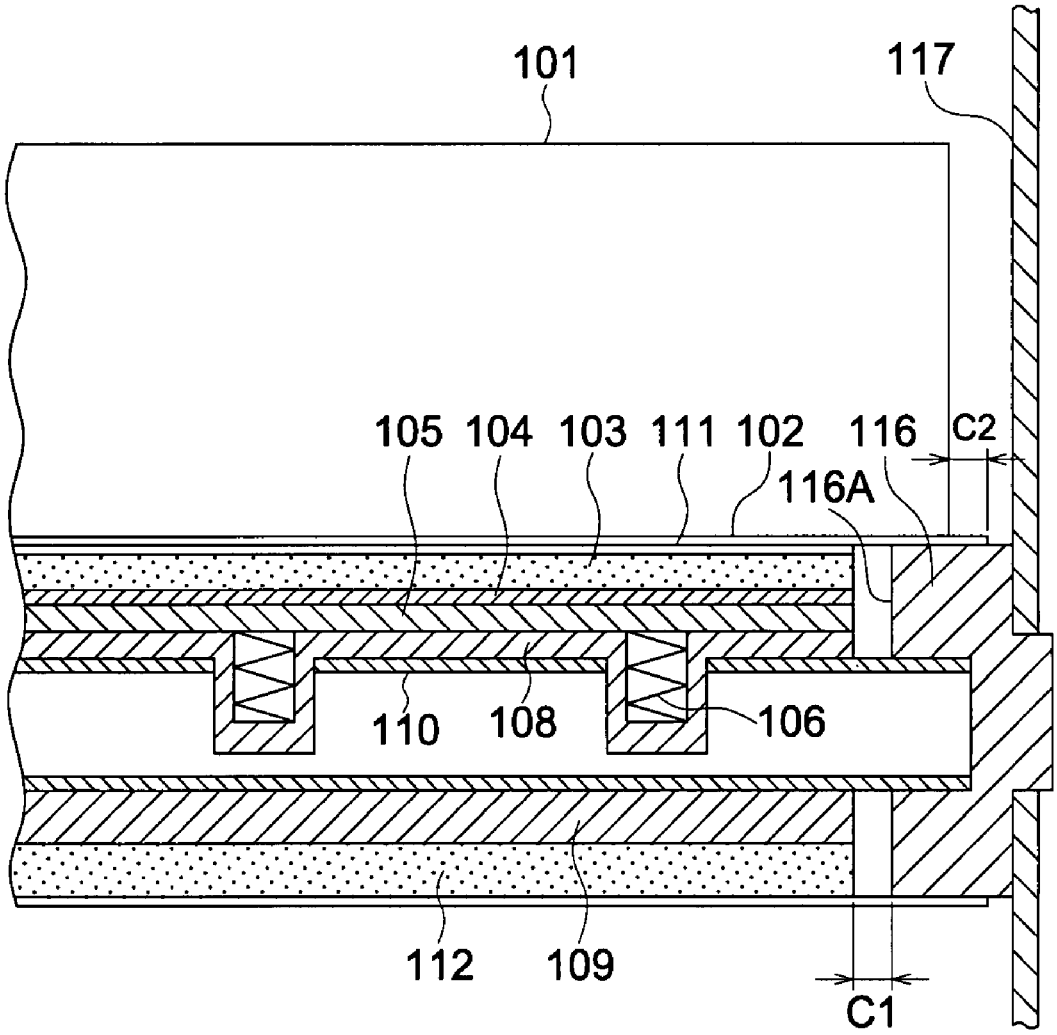
FIG. 3 is a sectional view of the fixing device, viewed from the longitudinal axis.

The form and dimension of fixing belt 102 and various members mounted within fixing belt 102, viewed from the longitudinal axis, will now be detailed while referring to FIG. 3.

The length of rotating fixing belt with respect to its axial direction (that is, the width of rotating fixing belt 102) is formed to be longer than that of all other members, other than frame 110, existing inside of fixing belt 102. Both ends of fixing belt 102 are supported on supporting members 116 from the inside. Supporting members 116 are supported by housing 117, which also supports various other members of fixing device 100.

Frame 110 is also formed to be longer than most of the other members which exist inside of fixing belt 102, and both projected ends of frame 110 are firmly inserted onto supporting members 116.

Silicon oil, supplied from oil pad 112, is coated on the inner surface of fixing belt 102. The silicon oil penetrates due to capillary action in the axial direction through the clearance between the inner surface of fixing belt 102 and sliding member 111. In this case, if the silicon oil turns over toward the front surface of fixing belt 102, it will cause fixing belt 102 to slip against fixing roller 101. Further the oil would adhere to recording sheet P, resulting in stains and damaged images.

To overcome these problems, neither end of sliding member 111 is formed to contact surfaces 116A of supporting members 116. Accordingly if the silicon oil, which exists in the clearance between the inner surface of fixing belt 102 and sliding member 111, penetrates due to capillary action in the axial direction, clearance C1, which is between supporting member 116 and sliding member 111, stops penetration of the silicon oil, and thereby the silicon oil can not seep around the ends of fixing belt 102 and onto its outer surface.

In addition, if oil pad 112, carrying the silicon oil, comes into contact with supporting members 116, the silicon oil can quite easily seep over the ends of fixing belt 102 and onto its outer surface. Therefore oil pad 112 is also formed to be separate from surfaces 116A of supporting members 116 by clearance C1.

Since holder 109 also comes into contact with the inner surface of fixing belt 102, holder 109 is also formed to be separate from surfaces 116A of supporting members 116 by clearance C1.

Base plate 104, base member 105, separating member 107 and holder 108, all of which do not come into contact with the inner surface of fixing belt 102, are formed to be separate from surface 116A of supporting members 116 by clearance C1.

Further, if any silicon oil adheres to the inner surface of fixing belt 102 and turns toward the outer surface of fixing roller 102 by some kind of reason, the silicon oil tends to migrate between fixing belt 102 and fixing roller 101 due to capillary action. For example, it means the case that the silicon oil in oil pad 112 adheres unnoticed onto the inner surface of fixing belt 102 during assembly of fixing device 100.

To overcome this problem, fixing roller 101 and fixing belt 102 are formed in such a way that both ends of fixing roller 101 are set to be shorter than both ends of fixing belt 102, so that clearance C2 is provided between both ends of fixing roller 101 and both ends of fixing belt 102.

Based on the above-described embodiment, without any specific feature to prevent the lubricant from turning toward the outer surface of the fixing roller, the lubricant, which exists in the clearance between the inner surface of the fixing belt and the sliding member, can be prevented from penetrating due to capillary action in the axial direction, and from turning toward the outer surface of the fixing roller.

What is claimed is:

1. A fixing device which fixes toner image on a recording material while using a nipping section which is formed between a fixing roller heated by a heating section and a fixing belt which is formed to be endless and rotated by the fixing roller, comprising:

a pressing section which presses the fixing belt from an inner peripheral surface of the fixing belt against the fixing roller;

a sliding member which is mounted between the fixing belt and the pressing section via a lubricant; and a supporting member which supports the inner peripheral surface of an end section of the fixing belt with respect to an axial direction of the fixing belt;

wherein a predetermined clearance is provided between the sliding member and the supporting member with respect to, the axial direction.

2. The fixing device of claim 1, further comprising:

a lubricant supplying member which carries the lubricant and is pressed against the inner peripheral surface of the fixing belt, wherein the predetermined clearance is provided between the lubricant supplying member and the supporting member with respect to each axial direction.

3. The fixing device of claim 1, further comprising;

a guide member which supports the pressing section and guides the fixing belt through the sliding member, wherein the predetermined clearance is provided between the guide member and the supporting member with respect to the axial direction of the fixing belt.

4. The fixing device of claim 1, wherein both ends of the fixing roller are located closer to a longitudinal center of the fixing roller than both ends of the fixing belt are to, with respect to the axial direction of the fixing belt.

5. The fixing device of claim 1, wherein the supporting member supports the inner peripheral surface at both end sections of the fixing belt.

6. An image forming apparatus which includes a fixing device, wherein the fixing device of claim 1.

* * * * *